US005926779A

United States Patent [19]

Garofalo

[11] Patent Number: 5,926,779

[45] Date of Patent: Jul. 20, 1999

[54] PORTABLE DIVING COMPUTER

[75] Inventor: Giovanni Garofalo, Rapallo, Italy

[73] Assignee: HTM Sport S.p.A., Italy

[21] Appl. No.: 08/848,564

[22] Filed: Apr. 28, 1997

[30] Foreign Application Priority Data

May 3, 1996 [IT] Italy ..... GE96A0039

[51] Int. Cl.[6] ..... G06F 15/00; B63C 11/02

[52] U.S. Cl. ..... 702/138; 128/204.23; 128/201.27; 128/202.22; 73/291

[58] Field of Search ..... 364/558, 418; 73/291, 432 R; 128/204.23, 205.23, 201.27, 202.22

[56] References Cited

U.S. PATENT DOCUMENTS 4,586,136 4/1986 Lewis ..... 364/418
4,782,338 11/1988 Barshinger ..... 340/754
4,831,500 5/1989 McNemar ..... 362/23
5,503,145 4/1996 Clough ..... 128/204.72

FOREIGN PATENT DOCUMENTS

0428131 A2 5/1991 European Pat. Off. .

*Primary Examiner*—Kamini Shah
*Attorney, Agent, or Firm*—Larson & Taylor

[57] ABSTRACT

Diving computer includes a pressure sensor, a timer, a processing unit and a display screen. The processing unit processes the pressure and time data according to a given algorithm and shows on the display screen at least the data relating to how long the diver can stay at a given depth within the decompression curve. The computer is also provided with one or more mechanisms for signalling an alarm. This signalling mechanism includes a mechanism for producing permanent visual signals differentiated according to the seriousness of the errors made, which signals are controlled by the processing unit.

8 Claims, 3 Drawing Sheets

PORTABLE DIVING COMPUTER

BACKGROUND OF THE INVENTION

The present invention relates to diving computers. The generic term "computer" is used in the field of diving equipment for those kinds of devices that include a processing unit which uses a given algorithm to process the data about length of time underwater and depth, supplied, respectively, by a timer which is started at the beginning of the dive and a pressure sensor. From its calculations, the processing unit then produces an output consisting of how many more minutes the diver can stay before deviating from the decompression curve, which relates the length of time spent underwater to the depth. Auxiliary data are also provided, such as the amount of time spent underwater and the greatest depth reached.

When the values deviate from the decompression curve, whether through some accidental error or a deliberate act, the so-called computer has the capacity to give an acoustic and/or visual signal. It is designed to detect dangerous situations and to respond by emitting an alarm in a large number of cases, as many as ten or more in the more sophisticated models. In addition, many computers are able to store the dive history in the memory of the processing unit, and even to annotate errors committed.

However, the devices described above present the drawback of not keeping a sort of "list" of errors committed visible throughout the dive. The danger of this is that an accumulation of small errors can expose the diver to serious danger. Moreover, the system generally fails to discriminate between more serious errors and minor errors, which it reports without distinguishing between them

SUMMARY OF THE INVENTION

It is an object of the invention to provide a computer capable of distinguishing more serious errors from those that are less serious, giving a permanent indication of both, and also calculating the accumulation of these errors and the effect of such accumulation on diver safety.

The subject of the invention is therefore a diving computer comprising a pressure sensor, a timer, a processing unit and a display screen, which processing unit processes the pressure and time data according to a given algorithm and shows on the display screen at least the data relating to how long the diver can stay at a given depth within the decompression curve, said computer being provided with one or more means for signalling an alarm, characterized in that said visual means for signalling an alarm include means for producing permanent visual signals differentiated according to the seriousness of the errors made, which signal means are controlled by the processing unit.

In particular, the control of the operation of said signal means by said processing unit involves comparing the errors made during the dive, classifying the seriousness of said errors, storing them, counting the errors according to their seriousness and permanently signalling the errors made.

Thanks to the above features, it is possible to direct the attention of the diver to a number of under water behaviour errors which—per se—may not cause serious harms, as the formation of microbubbles or of slight phenomena of embolism or which simply may not be recommended to a not very expert diver. Therefore, the computer according to the invention performs what may be termed an underwater behaviour analysis, rather than simply the signalling of true errors, through the monitoring of not-recommended behaviours, even if same do not constitute serious errors.

That is, it signals also behavior which may not be recommended to a careful diver.

A second important aspect of the computer according to the invention is that of the illumination of the computer. Many underwater instruments may be illuminated. However, none of them has the possibility of a permanent illumination, that is an illumination during the whole time of diving According to the invention, the permanent illumination may be obtained thanks to two main factors, namely:

1) The use of alkaline batteries, which may be easily replaced, easily obtained and at low costs. With three of such batteries it is possible to obtain about 30 hours of illumination
2) The use of a double consent in order to avoid fortuitous illuminations In fact, the computer is programmed in such a manner that the illumination takes place in a continuous manner only if controlled through the double consent of two push buttons which may be operated under water .

BRIEF DESCRIPTION OF THE DRAWINGS

Further advantages and features of the device according to the invention will be made clear by the following detailed description of an embodiment thereof. This description, which is intended as a non-limiting example, refers to the attached drawings, in which.

DESCRIPTION OF THE PREFERRED EMBODIMENT OF THE INVENTION

Figure 1:
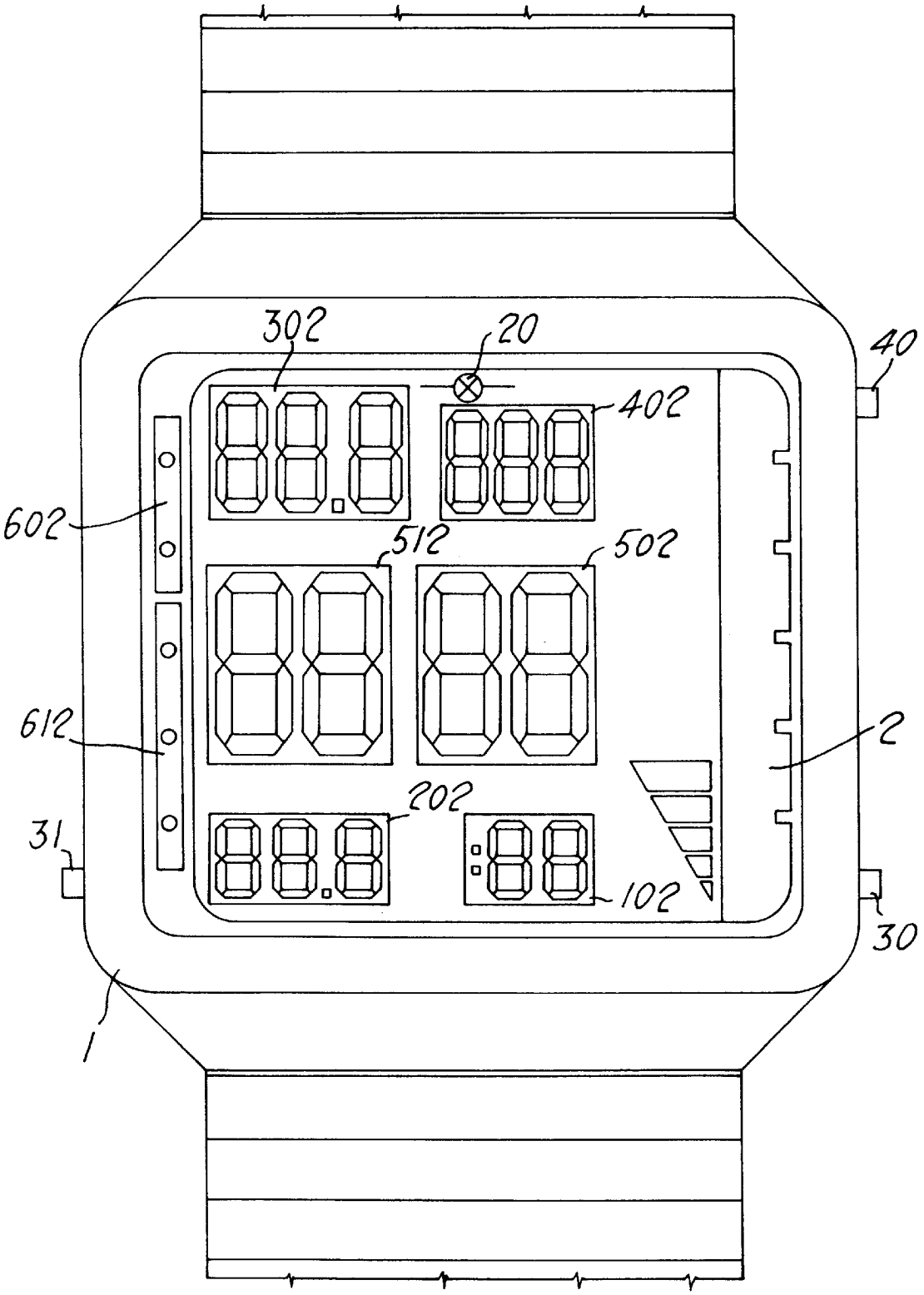
FIG. 1 is an elevation of the diving computer according to the invention.

FIG. 1 shows a diving computer according to the invention. The case 1 containing the device has a display screen 2 containing the various displays for the values supplied by the computer, in the present case, for example, the dive duration display 102, the water temperature display 402, the depth display 302, the display 202 of greatest depth reached, the displays 502 and 512 of the data processed by the computer for the length of time permissible within the decompression curve, and the alarm signals 602 and 612 for serious errors and minor errors respectively. The screen also has a light 20 controlled by the button 30, which has a lock button 31, the two being positioned on opposite sides of the case 1; when pressed together, the two buttons provide continuous illumination of the display screen.

Devices of this kind are normally fitted with illumination which comes on at the press of a button and ceases when the button is released. The introduction of the lock button 31 is intended to make the computer more convenient to use in deep water; when the button 30 is depressed a second time, the lock provided by the button 31 is disengaged and the illumination ceases. The locking action of the button 31 can be produced either by means of a mechanical locking action, in which case the button 30 could provide locking means of this type itself, such as for example a lock screw, or by means of an electronic lighting lock circuit. Also on one side of the case 1 is the key 40 for controlling the functions of the computer.

Figure 2:
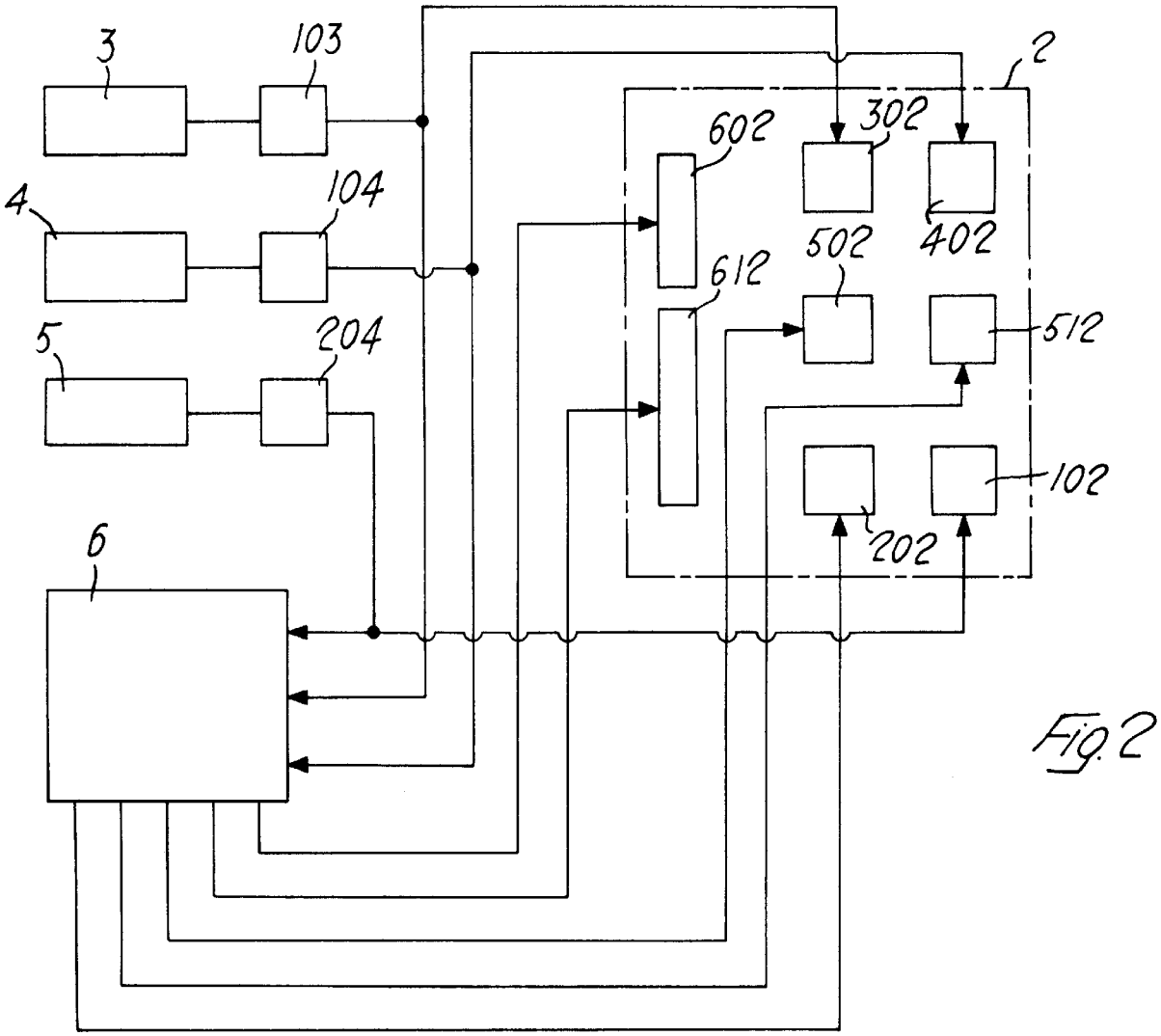
FIG. 2 is a block diagram of the operation of the computer according to the invention.

Shown diagrammatically in FIG. 2 is the operation of the computer according to the invention The computer, in a manner known per se, comprises the pressure sensor 3, the temperature sensor 4, the timer 5, the processing unit 6 and the display screen 2 which contains the displays illustrated in FIG. 1 and shown here in block form The sensors 3 and 4 and the timer 5 send their data, suitably preprocessed in suitable transducers 103, 104 and 105 respectively, both to the processing unit 6 and to the corresponding displays, namely to the display 102 for the timer 5, to the display 302 for the pressure sensor 3, which gives the depth readout in metres, and to the temperature value of the display 402 for the sensor 4.

Figure 3:
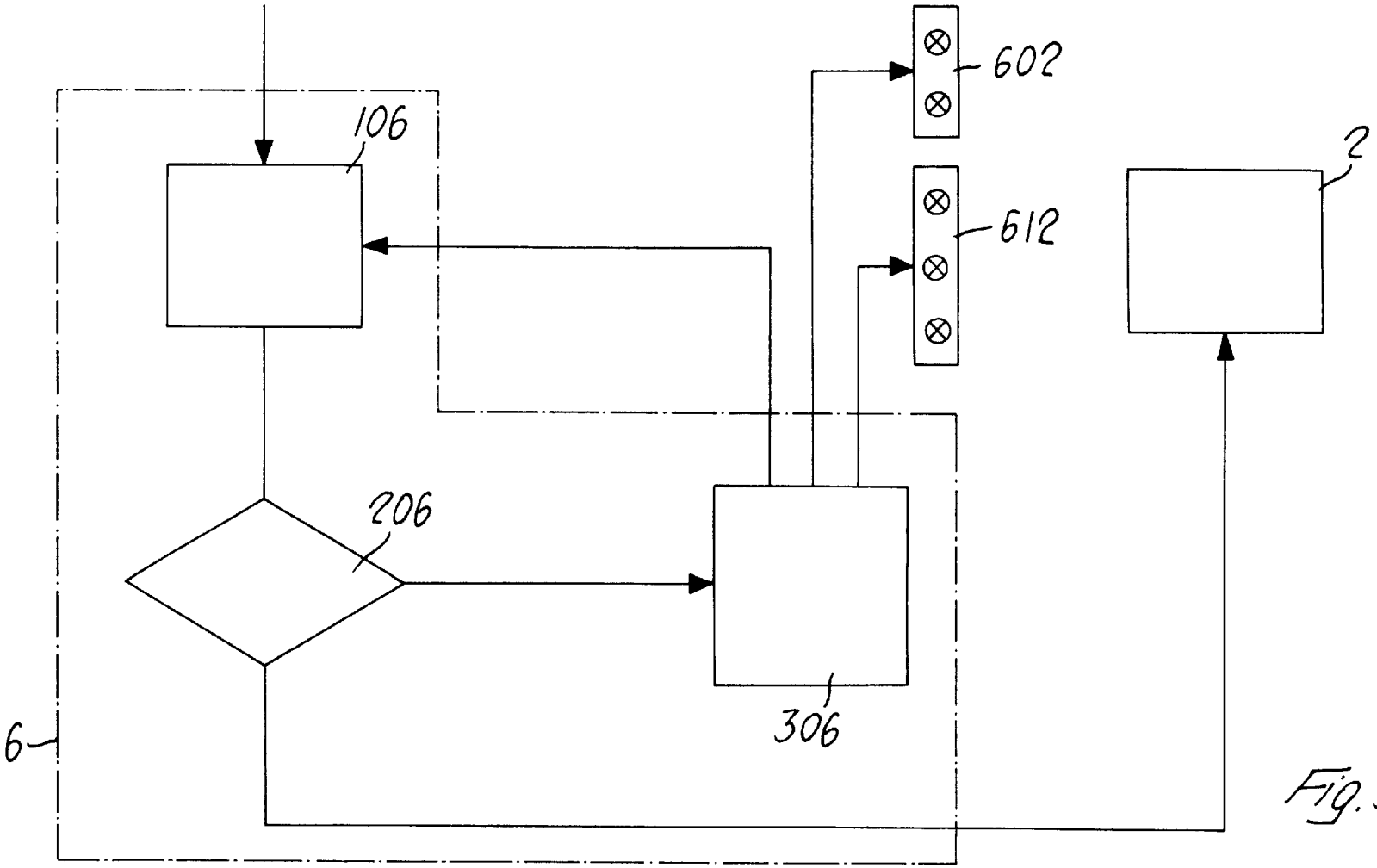
FIG. 3 is a flow chart showing how the data is processed in the computer according to the invention.

The acquired data are processed using one of the known algorithms taking account of a number of different standard tissues for nitrogen saturation. The processing unit 6 then produces the data, displayed at 502 and 512, which concerns, at least the remaining permissible time at the depth reached if the decompression curve is to be kept to. If the operations of the diver do not keep to safe values, the unit 6 sends a signal to the alarm displays 602 and 612, which may for example be two series of light-emitting diodes, or may equally well be liquid crystal displays The procedure for signalling errors is illustrated in more detail in the flow chart shown in FIG. 3. In the processing unit 6, the data acquired and processed in the step identified by the numeral 106 are compared in 206 with the safe values; then, if the processed data derived from them satisfies the conditions of the decompression curve it is shown in the displays of the display screen 2. If however this relationship is not satisfied, the outputs are reexamined from the point of view of the seriousness of the error in 306 and also stored in the light of this assessment. The visual alarm signal of the two displays 602, 612 is permanent, and a subsequent error by the diver, with a display of the type illustrated diagrammatically in the Figures, will light up the next section of the display scale. The processing unit 6 can also add together two or more minor errors when their seriousness gives rise to a risk equal to a more serious error.

The diving computer thus designed allows the diver to see, quickly and at any time, what errors have been committed, with a clear reference to their relative seriousness and to their cumulative seriousness.

I claim:

1. A diving computer comprising a pressure sensor, a timer, a processing unit and a display screen, said processing unit processing pressure and time data produced by said pressure sensor and said timer according to a given algorithm and showing on said display screen at least data relating to how long a diver can stay at a given depth within a decompression curve, said computer having means for signalling an alarm, said means for signalling an alarm including means for producing first and second permanent visual signals differentiated according to minor errors and serious errors made, said first signal being triggered by a minor error and said second signal being triggered by one of a serious error and at least two different minor errors which, when combined, constitute a serious error, said visual signal producing means being controlled by said processing unit.

2. A diving computer according to claim 1, wherein control of operation of said visual signal producing means by said processing unit involves comparing the errors made during the dive, classifying the errors by seriousness, storing the errors, counting the errors on the basis of their seriousness and permanently signalling the errors made.

3. A diving computer according to claim 2, wherein said visual signal producing means comprises at least one series of visual signal components.

4. A diving computer according to claim 3, wherein said visual signal producing means include light-emitting diodes.

5. A diving computer according to claim 3, wherein said visual signal producing means include liquid crystal displays.

6. A diving computer according to claim 1, wherein said display screen includes means for illumination, with on and off conditions of light emitted from the illumination means being controlled by at least a first button.

7. A diving computer according to claim 6, wherein said illumination means includes mechanical lock means for locking light from said illumination means in the on condition.

8. A diving computer according to claim 6, including electronic means for locking and unlocking light from said illumination means in the on condition, said electronic means being controlled by operating said first button and a second button simultaneously.

* * * * *